United States Patent [19]

Gulliksen et al.

[11] 4,386,391

[45] May 31, 1983

[54] LUMINAIRE APPARATUS WITH MULTIPLE LIGHT SOURCES INCLUDING METHOD AND MEANS FOR SWITCHING AND ADJUSTING FOCUS OF THE LIGHT SOURCES

[75] Inventors: John E. Gulliksen, Shrewsbury; Roy A. Guimond, Holden; Charles F. Daly, Boylston, all of Mass.

[73] Assignee: Koehler Manufacturing Company, Marlborough, Mass.

[21] Appl. No.: 173,057

[22] Filed: Jul. 28, 1980

[51] Int. Cl.[3] ..... F21V 1/00

[52] U.S. Cl. ..... 362/232; 362/240; 362/250; 362/285; 362/372

[58] Field of Search ..... 362/232, 240, 250, 285, 362/372

[56] References Cited

U.S. PATENT DOCUMENTS 3,953,724 4/1976 Ouchi ..... 362/287

*Primary Examiner*—Stephen J. Lechert, Jr.

*Attorney, Agent, or Firm*—Hamilton, Brook, Smith & Reynolds

[57] ABSTRACT

A holder, for example a multiple light source socket, is mechanically travelled in a supporting structure, in both rotary and linear paths of travel. Rotary travel provides for interchangeably locating lamps along a focal axis in a luminaire housing. Linear travel of the socket provides a focusing adjustment for each lamp along the focal axis to position it at a desired point of focus. In one form the supporting structure may comprise a miner's cap lamp having an externally located knob which may be manually turned by a miner to move the socket member. Other forms of supporting structures and movable parts may be provided as hereinafter disclosed.

15 Claims, 38 Drawing Figures

Fig. 5
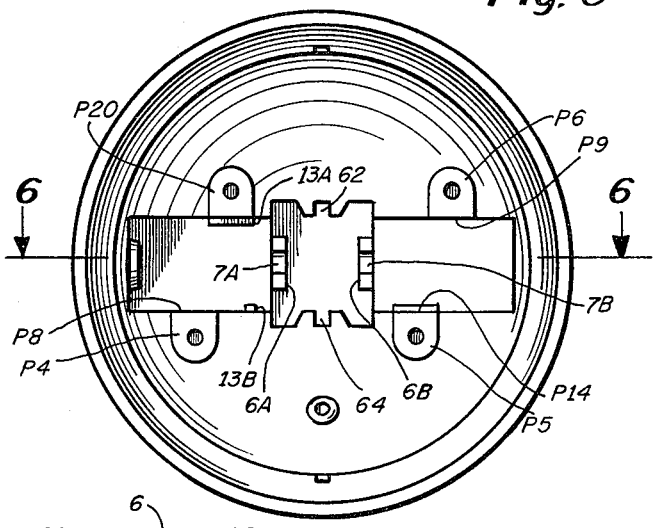
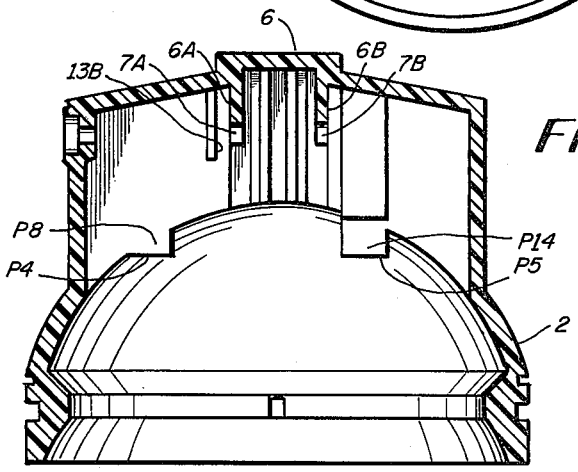
Fig. 6
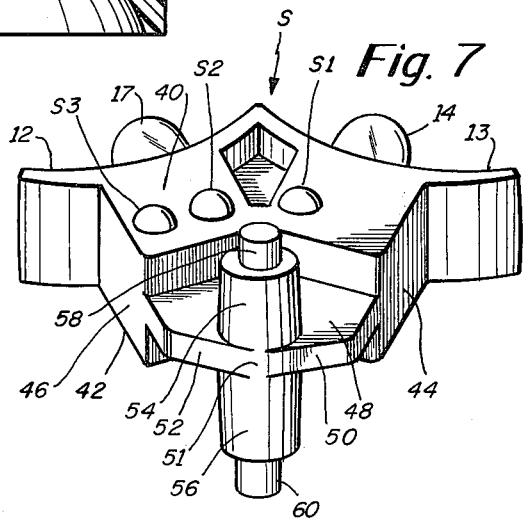
Fig. 7

Fig. 14
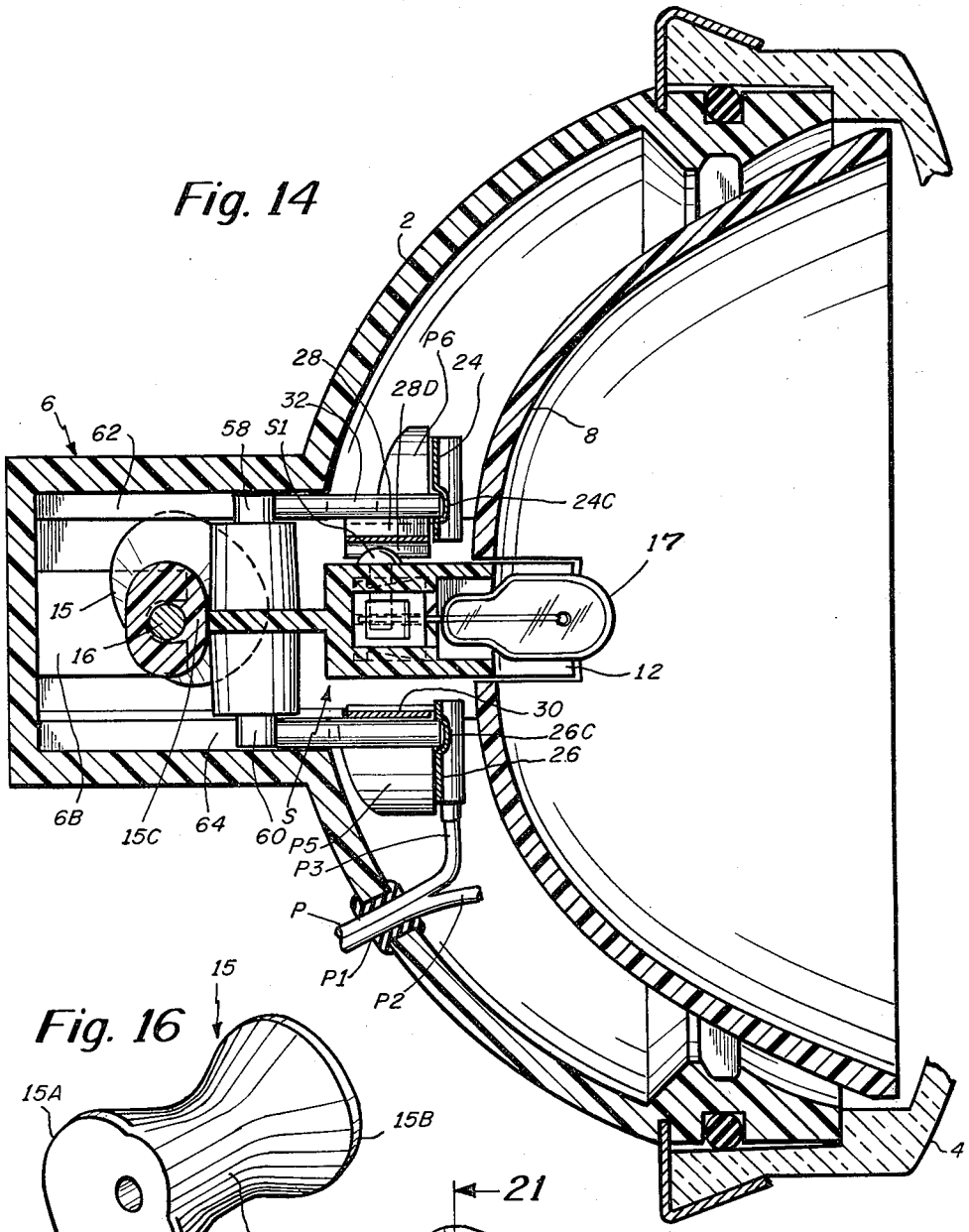
Fig. 16
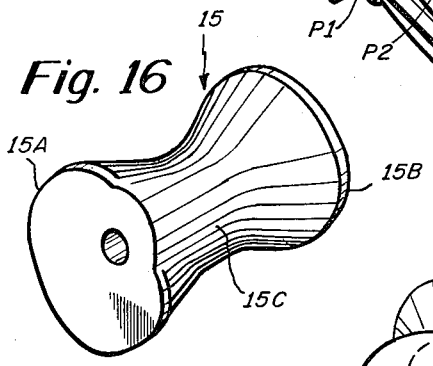
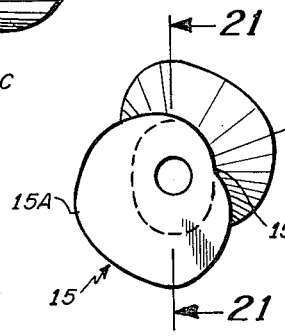
Fig. 17

| X | R | X | R |
|---|---|---|---|
| -.250" | .125" | .250" | -.125" |
| -.225 | .125 | .225 | -.125 |
| -.200 | .125 | .200 | -.125 |
| -.175 | .125 | .175 | -.125 |
| -.150 | .125 | .150 | -.125 |
| -.125 | .125 | .125 | -.125 |
| -.100 | .125 | .100 | -.125 |
| -.075 | .125 | .075 | -.125 |
| -.050 | .125 | .050 | -.125 |
| -.025 | .125 | .025 | -.125 |
| .000 | .125 | .000 | -.125 |
| .025 | .1273 | -.025 | -.1273 |
| .050 | .1345 | -.050 | -.1345 |
| .075 | .1475 | -.075 | -.1475 |
| .100 | .1688 | -.100 | -.1688 |
| .125 | .2055 | -.125 | -.2055 |
| .150 | .2488 | -.150 | -.2488 |
| .175 | .2921 | -.175 | -.2921 |
| .200 | .3285 | -.200 | -.3285 |
| .225 | .3285 | -.225 | -.3285 |
| .250 | .3285 | -.250 | -.3285 |

LUMINAIRE APPARATUS WITH MULTIPLE LIGHT SOURCES INCLUDING METHOD AND MEANS FOR SWITCHING AND ADJUSTING FOCUS OF THE LIGHT SOURCES

BACKGROUND OF THE INVENTION

It has been recognized in the luminaire art that it is advantageous, in certain types of luminaires, to provide dual light sources, the second of which may be tilized as a backup light source in the event of failure of the first or primary light source.

Desirable features of such an arrangement may include: (1) substantially identical operating and optical characteristics of the system, regardless of which light source is energized; (2) both light sources focusable, i.e. the dimensional relationship between the filament of the energized light source and the focal point of the optical system (reflector, lens, etc.) being adjustable along the focal, i.e., central axis of the optical system; (3) switching means to selectively energize and position the light sources, as well as to provide an "off" (neither source energized) position; and (4) switching, positioning and focusing preferably being accomplished by rotation of a single switch knob mounted externally of the luminaire apparatus.

Use of multiple light sources and means for energizing such light sources is well known in the art and has been disclosed, for example, in U.S. Pat. Nos. 1,184,400, 1,845,399, 2,079,732, 3,529,146, 3,529,147, 2,123,435 and 1,757,887.

More recently, there has been disclosed in U.S. patent application Ser. No. 886,783, which application has been assigned to the assignee of the present invention, a rotating socket arrangement carrying a plurality of bulbs combined with a housing body and operated by manual rotation of a knob member to selectively move one bulb out of a focal point of an optical system and another bulb into the said focal point while energizing same.

There is not disclosed in this earlier filed application means for providing individual focusing of either of the light sources. Similarly, the multiple light source arrangements of the prior art patents noted above do not provide for individual focusing of alternative light sources. To date no proposed system, so far as applicants are aware, has met all of the above criteria in a satisfactory manner.

SUMMARY OF THE INVENTION

This invention is concerned with a luminaire apparatus having multiple light sources and with a method and means for switching and adjusting focus of the light sources. The invention further relates in general to an improved method and apparatus for mechanically producing travel of a holder part in a supporting structure, wherein the movable part may be reversibly rotated, with its axis of rotation being movable along a linear path of travel which is at right angles to the said axis of rotation.

It is a chief object of the invention to provide an improved luminaire apparatus in which a backup or emergency light source is provided in addition to a primary light source. A luminaire of the sort used as a miner's cap lamp is particularly of interest.

It is another object of the invention to provide two or more separate light sources in the form of separate bulbs, selectively energizable by manual adjustment of a switch knob located externally of the luminaire body, in which each of the light sources, when energized, will provide optical lighting characteristics of substantially equivalent quality but which may have differing intensity.

It is a still further object of the invention to provide individual focus adjustment for each energized light source, to be accomplished by moving the said light source along a focal axis of the optical system of the luminaire apparatus.

Still another object of the invention is to provide an "off" position in which no bulb is energized in a location intermediate of adjacent energized positions.

Still another object of the invention is to provide all of the functions recited above by means of continuous and reversible rotation of a single switch knob.

It has been determined that the foregoing objectives may be realized by mounting a holder body such as a multiple light source socket in a supporting structure which may be a luminaire housing having a reflector body to produce both rotary and linear travel. In carrying out these motions there has been devised a unique cam structure and cam follower part. The cam follower part is constructed integrally with the multiple light source socket and is arranged to be resiliently held in engagement with the cam structure. Rotary travel induced, for example, by turning the cam structure with a knob located externally of the luminaire housing provides for interchangeably locating lamps in the multiple light source socket along a focal axis of the reflector body. Linear travel of the socket, also induced by rotating the cam structure, provides a focusing adjustment for each lamp along the focal axis to position it at a desired point of focus. A further important feature of the invention is the construction of the luminaire housing with chambers and guide parts as well as channeled portions in which the movement of the components may be carried out in a desired manner.

BRIEF DESCRIPTION OF THE DRAWINGS

FIG. 5 is a front elevational view of the housing body with all components removed.

FIG. 6 is a plan cross-sectional view taken centrally of FIG. 5.

FIG. 7 is a detail perspective view of a dual socket component of the invention as viewed from the rear to illustrate a cam follower portion formed in the socket member.

FIG. 14 is a vertical cross-sectional view of the apparatus.

FIG. 16 is a perspective view of a cam element.

FIG. 17 is an end view of the cam element of FIG. 16.

DETAILED DESCRIPTION OF THE INVENTION

The present invention relates broadly to an improved method and apparatus for mechanically producing travel of a movable holder part in a supporting structure, wherein the holder part may be reversibly rotated with its axis of rotation being reciprocably movable along a linear path of travel which intersects at right angles to the said axis of rotation. Travel of the holder part, thus controlled, is based upon the concept of utilizing a three-dimensional cam which, in a preferred embodiment, is of lobular construction presenting a surface mathematically derived from a plurality of predetermined dimensional relationships.

In one preferred form the invention is concerned with a luminiare apparatus characterized by multiple light sources in a movable socket structure, and further characterized by a cam follower and three-dimensional cam arrangement for switching and adjusting the light sources in a manner particularly suited to the requirements for a miner's cap lamp apparatus.

Principal parts of the invention apparatus include: (1) a housing which is formed with a cam and socket chamber and having a switch knob located at one side thereof; (2) a reflector body which is mounted in the housing and formed with a socket aperture; (3) a cam assembly rotatably supported in the cam and socket chamber; (4) a multiple light source socket located between the cam assembly and the reflector body and mounted for rotation in the cam and socket chamber about an axis of rotation which is perpendicular to the axis of rotation of the cam assembly; and (5) means for resiliently urging the socket into engagement with the cam assembly.

Figure 1:
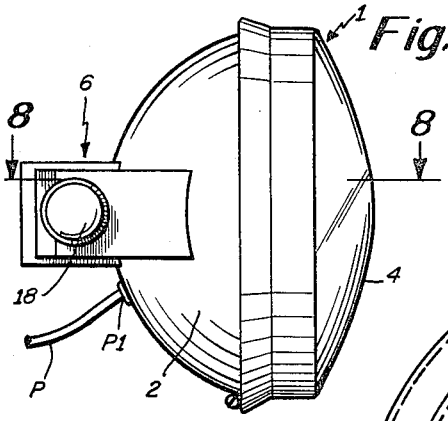
FIG. 1 is a side elevation of the luminaire apparatus of the invention.
Figure 2:
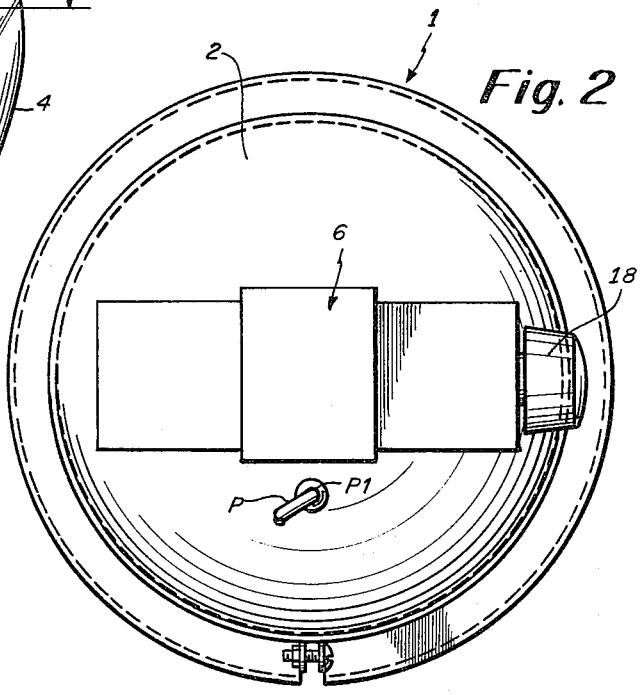
FIG. 2 is a rear elevational view of the apparatus of FIG. 1.

Considering these parts in more detail, attention is directed to FIG. 1. This Figure illustrates one embodiment of the invention apparatus generally denoted by the arrow 1 and includes a housing 2 closed at one side by a lens 4. At an opposite side the housing is formed with an extension, denoted by the arrow 6. The extension 6 constitutes an enclosure which defines a cam and socket chamber hereinafter described in detail. In FIG. 2 the extension 6 is further illustrated as viewed from the rear. When used in a miner's cap lamp embodiment, earlier referred to, as a part of a miner's headpiece, the knob 18 is in a position to be operable by a miner wearing a headpiece.

Figure 3:
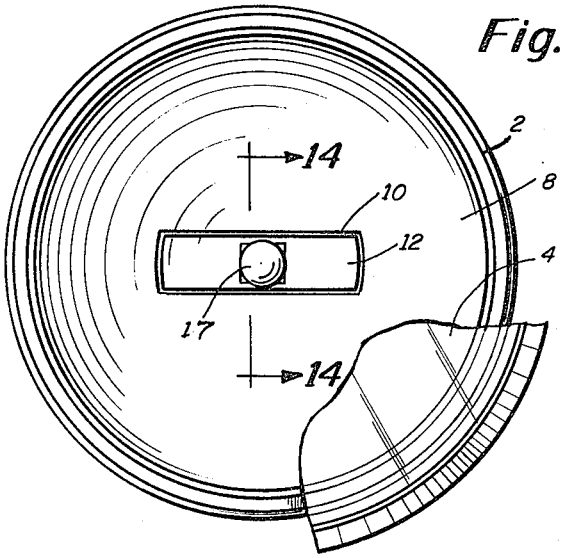
FIG. 3 is a front elevational view of the apparatus with a lens portion partly broken away to show a socket aperture and bulb mounted in the socket.

In FIG. 3 the front of the housing 2 is illustrated with portions of the lens 4 being broken away to more clearly show a reflector body 8. An inner part of reflector body 8 is removed to provide a socket aperture 10 in which is received a socket reflector portion 12 and a bulb member 17.

Figure 4:
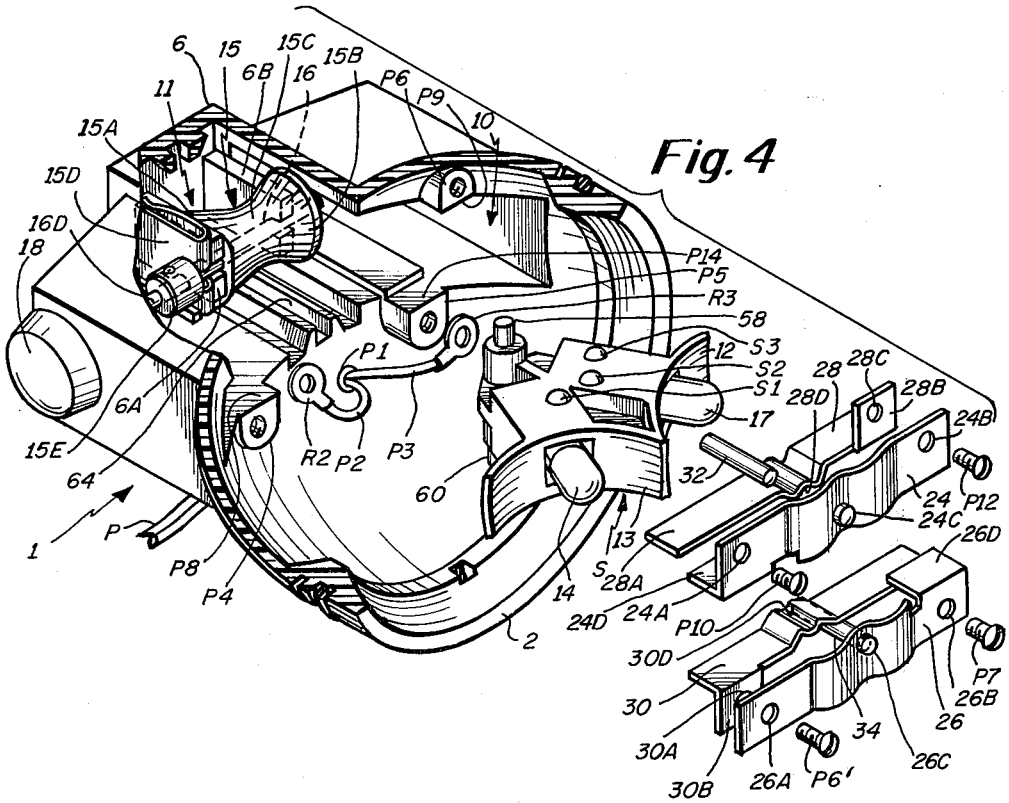
FIG. 4 is an exploded view of the apparatus showing constituent parts thereof in perspective.

FIG. 4 illustrates the housing 2 on a larger scale and with a portion broken away to more clearly show the cam assembly rotatably mounted in a cam and socket chamber denoted by arrow 11. Arrow S denotes a multiple light source socket removed from the chamber, together with means for engaging the socket with the cam assembly. In this embodiment the socket is designed to receive a pair of bulbs including bulbs 17 and 14.

Included in the cam assembly shown in FIG. 4 is a cam member denoted by arrow 15. This cam member constitutes a highly important component of the invention and is characterized by a unique lobular construction wherein a pair of lobes 15A and 15B are arranged in predetermined spaced relationship to one another at opposite sides of an intermediate body portion 15C of a reduced substantially oval cross-section. The shape of the cam 15 and the arrangement of the lobes 15A and 15B with respect to one another are further illustrated in various operative positions in FIGS. 8, 9, 10, 11, 12 and 13. FIGS. 16 and 17 are detail Figures still further intended to illustrate the construction of the cam portions 15A, 15B and 15C.

From an inspection of these Figures it will be observed that the peripheral dimensions of the intermediate body portion 15C, taken centrally of its longitudinal axis, is at a minimum value. Increasing peripheral dimensions are present in the cam surfaces extending outwardly along either side of the intermediate body portion 15C. A disclosure of the derivation of these peripheral dimensions of increasing magnitude is hereinafter disclosed in detail.

Cam 15 (FIG. 4) is mounted on a shaft 16 which is rotatably received through shaft supporting walls 6A and 6B formed integrally with the inner side of the housing extension 6. The supporting walls 6A and 6B are more clearly shown in FIG. 5 and include bearing portions 7A and 7B for shaft 16. These walls are also arranged in spaced apart relation to constitute inner guide surfaces for opposite outer ends of the cam 15 when the shaft 16 is rotated. These wall portions 6A and 6B are also shown in FIG. 6.

Figure 8:
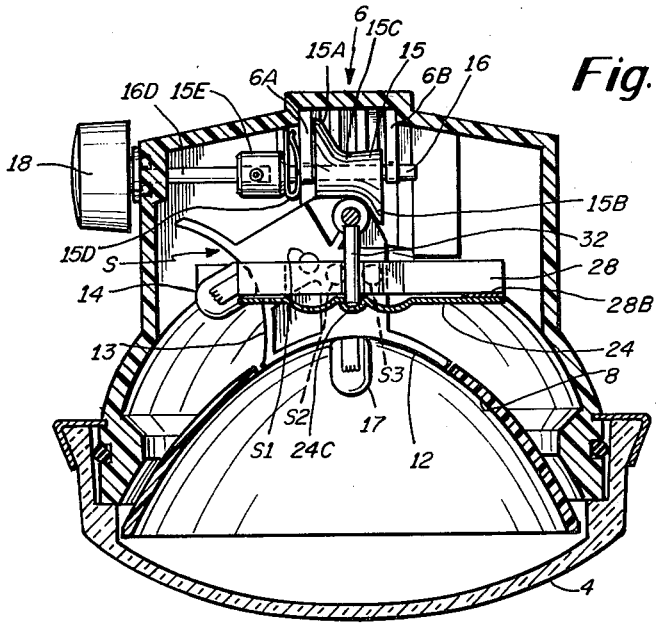
FIG. 8 is a plan cross-section taken on the line 8—8 of FIG. 1.
Figure 9:
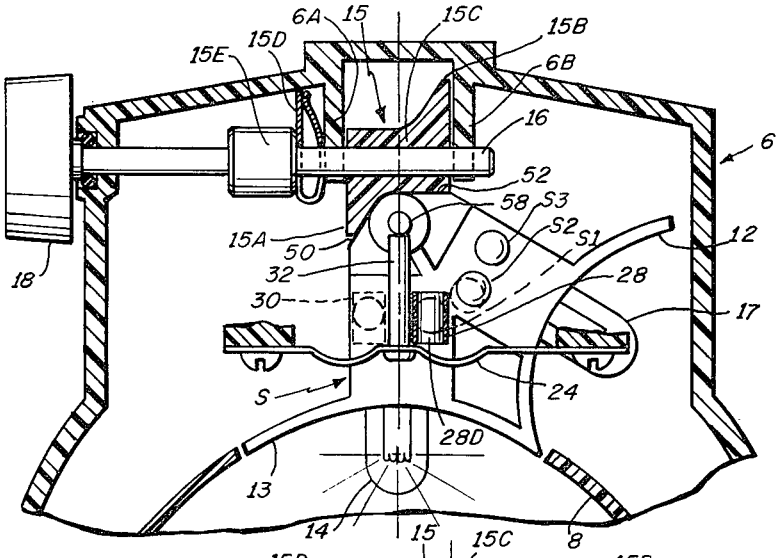
FIG. 9 is a plan cross-section similar to FIG. 8, but showing the socket component in a different position of adjustment.
Figure 10:
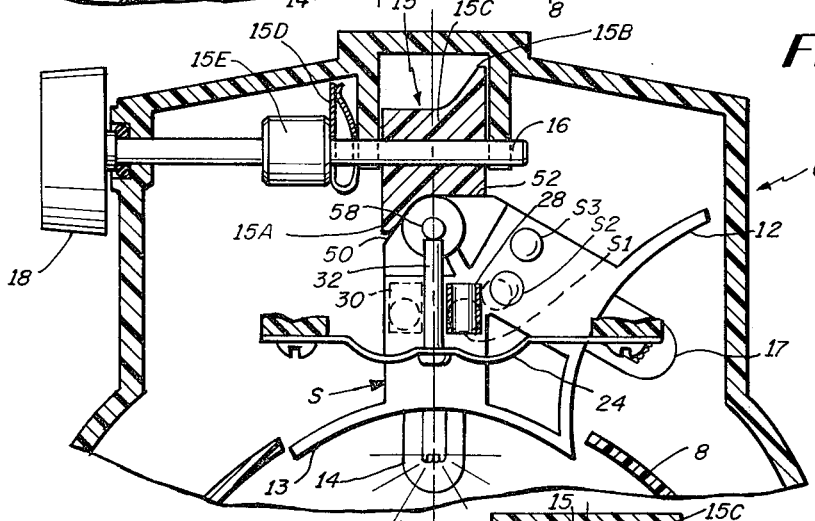
FIG. 10 is another cross-section similar to FIGS. 8 and 9, but illustrating the socket advanced forwardly in the housing to provide a focusing adjustment.
Figure 11:
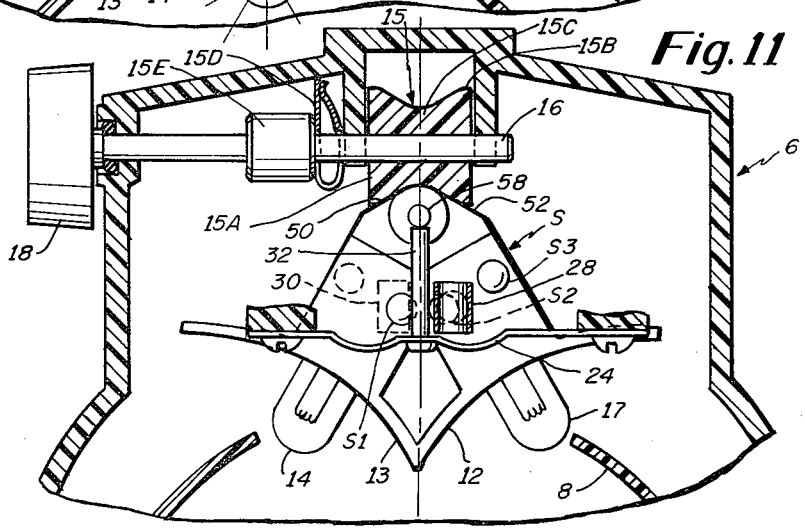
FIG. 11 is another view similar to FIGS. 8–10, but illustrating the socket in an intermediate "off" position of the electrical switching means.
Figure 12:
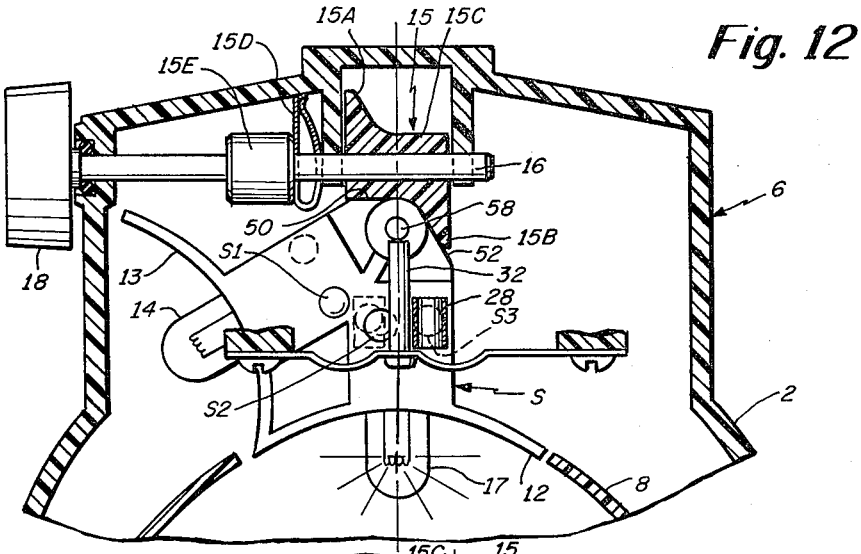
FIG. 12 is a view further illustrating the apparatus of FIGS. 8–11 with the socket having been rotated to position a second bulb along the focal axis.
Figure 13:
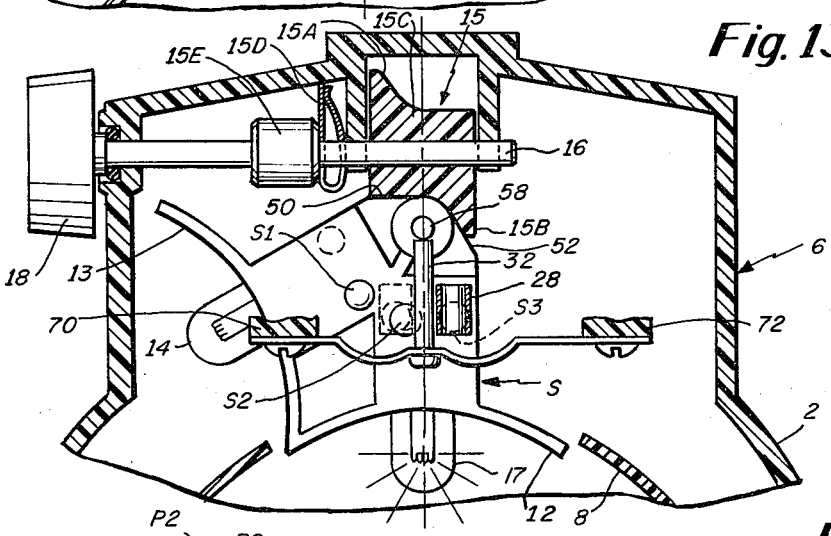
FIG. 13 again illustrates the arrangement of FIG. 12 with the socket in an advanced position.
Figure 15:
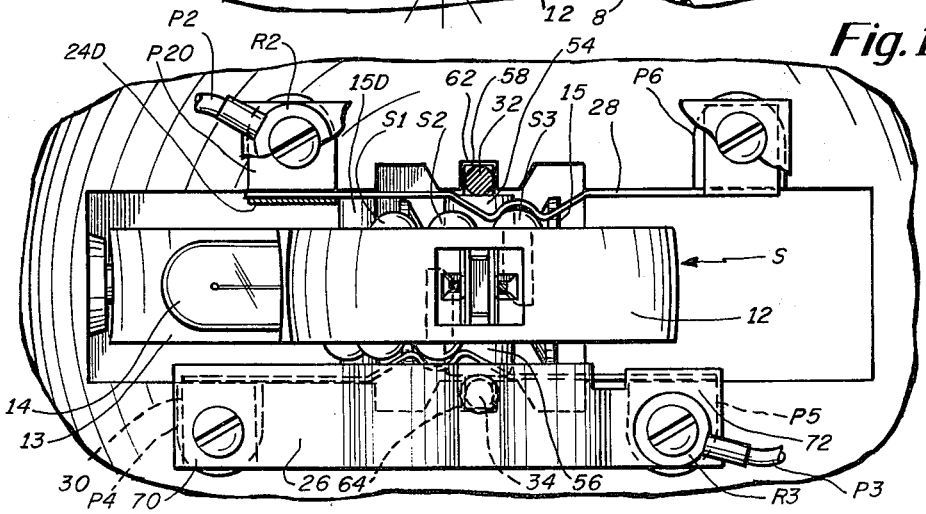
FIG. 15 is a detail elevational view showing fragmentarily portions of the housing and electrical engagement of the contact elements.

Friction spring element 15D is compressibly held between the wall portion 6A and projection 13A and 13B more clearly shown in FIG. 5. A collar 15E, which is solidly fixed on shaft 16, resiliently bears against the friction spring 15D (FIG. 4). The cam and shaft are maintained, by means of the friction spring, in any position into which they may be turned. The collar 15E is formed with a hole in which is received and held a keying end of a shaft extension part 16D (FIG. 8). An outer end of shaft extension 16D is located through one side of housing extension 6 and supports the knob 18 fixed thereon for manually turning the shaft 16 and the cam 15.

Referring in further detail to FIG. 4, the multiple light source socket S is shown in separated relationship to the cam member 15. Also shown in separated relationship to the socket S is shown means for resiliently engaging the socket S with the cam 15 including retaining spring members 24 and 26 and driver pins 32 and 34. Also indicated in FIG. 4 are electrical contact springs 28 and 30 as well as electrical contact buttons S1 and S3, separated by a non-conductive button S2 located on the socket member.

Electrical current is supplied, for example, from a miner's cap lamp battery or other suitable source and is conducted through the housing into the cam and socket chamber through a cable P received in a suitable cable entry P1, as shown in FIG. 1. Cable conductors P2 and P3, illustrated in FIG. 4, are designed to have connector ring terminations R2 and R3, detachably secured against internally threaded lug portions P4 and P6 which are formed integrally with the inner side of the housing 2 and which present flat surfaces P8 and P9. The connector ring termination R2, together with contact spring 30 and retaining spring 26, are secured to lugs P4 and P5 by screws P6' and P7.

In assembling the parts noted, contact spring 30 has its end portions positioned on respective flat surfaces P8 and P14 of the lugs P4 and P5 and screw P6' is located through a hole 30A in an angle part 30B of contact spring 30. Screw P6' also passes through a hole 26A of retaining spring 26 to hold both the contact spring and the retainer spring in firmly anchored relationship against the internally threaded lug P4. Similarly, screw P7 is located through a hole 26B in retaining spring 26 and threaded into lug P5. Spring 26 is formed with an angle part 26D which overlies an adjacent end portion of contact spring 30 and, when the screw P7 is threaded into the lug P5, it secures both the contact spring and retaining spring in fixed relation to the lug P5.

It will be understood that a second set of internally threaded lug portions are provided having a second set of flat surfaces (not shown in FIG. 4). Screw P10, as shown in FIG. 4, is located through a hole 24A in retaining spring 24 which is formed with an angle part 24D for engaging against an end 28A of contact spring 28. The end 28A and angle part 24D are firmly fixed together against an internally threaded lug portion P20 (FIG. 5) into which screw P10 is threaded. Screw P12 is located through hole 24B of retaining spring 24 and also passes through a hole 28C in an angle part 28B. The spring elements 24 and 28 are held together by screw P12 in the manner already described.

It will be noted that the retaining springs 24 and 26 are formed with flexible intermediate portions having respective driver pin retainer parts as 24C and 26C in which driver pins 32 and 34 may be engaged and, as is later described, provide for reciprocating movement of the driver pins while the said pins are constantly held under tension.

In addition, the contact springs 28 and 30 are formed with detents 28D and 30D in which respective contact buttons are guided during linear travel of the socket in the operation of the cam and socket mechanism.

It is pointed out that, in engaging the socket with the cam 15, it is essential that the socket be provided with suitable cam follower means. Such cam follower means is illustrated in further detail in FIG. 7. As will be noted therein, socket S includes a body portion which presents parallel spaced apart sides 40 and 42 and rearwardly converging walls 44 and 46 occuring at right angles to the sides 40 and 42. Formed integrally with the body portions is a cam follower extension 48, which may be of reduced thickness as shown in FIG. 7, and which is constructed with converging cam follower surfaces 50 and 52. Extending above and below the cam follower extension 48 are cylindrical parts 54 and 56 having respective trunnions 58 and 60 of reduced diameter. The surfaces 50 and 52 are tangential to the cylindrical parts 54 and 56 and end at their points of tangency to provide a substantially arcuate bearing portion 51.

At an opposite side the body portion of socket S is formed with dual reflector parts 12 and 13 (FIG. 8) in which are located the bulb members 17 and 14 noted above. It will be seen that the dimensional configuration of reflector parts 12 and 13 is chosen such that the socket aperture 10 in the reflector body 8 may be substantially closed by either reflector part. It will also be understood that while a dual lamp socket arrangement is employed in the embodiment described it may be desired to apply the principles of the invention to other forms of holder and cam bodies as disclosed below.

The socket body S, together with its cylindrical parts and the trunnions 58 and 60 of reduced diameter, are designed to be adjustably supported for both rotary and linear movement in suitably formed channel members for receiving and guiding the trunnions 58 and 60. In FIG. 5 a channel construction is illustrated, formed integrally of the housing 2 and consisting of spaced apart channels which are denoted by the numerals 62 and 64. These channels are shown in FIG. 5 and are also illustrated in FIGS. 5 and 14. It will be understood that the channels preferably are constructed, by molding or other means, as an integral part of the housing extension 6.

When assembling the various components of FIG. 4 in operating relationship to one another the shaft 16 is first fully engaged with the cam 15 and knob 18 is fixed at an outer end thereof. Friction spring element 15D, in a compressed state, is then engaged between projections 13A and 13B formed in the housing extension 6 and the wall 6A. The cam 15, shaft 16 and collar 15E are engaged in the housing such that the cam 15 is confined between wall parts 6A and 6B with opposite ends of the shaft 16 being received in bearing portions 7A and 7B. The driver pins 32 and 34 are then inserted into respective channels 62 and 64.

the member A30 to a position such that portion A2 is operative with its central axis A8 lying on the central axis A12 of the luminaire system noted above, will change $\alpha'$ to some other angle which may be defined as $\alpha'-\beta$, or in this case, 0°.

Figure 19:
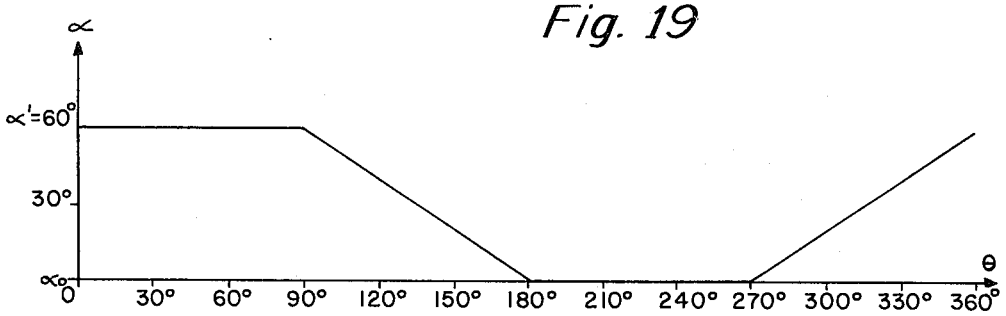
FIG. 19 is a graph showing values used to derive the surfaces of the cam.

It is desired to accomplish this switching in the second quadrant of rotation of cam member A28, with the full quadrant available for such switching. A return to the original position will be accomplished in the fourth quadrant of cam member rotation. This may be shown graphically by plotting the angle of cam member rotation, denoted by $\theta$, as an abscissa and angle $\alpha$ as an ordinate; such a plot is illustrated in FIG. 19.

It is also desired to provide, in this case, linear motion equivalent to a value of 0.062 inches. This motion will take place in an outward direction (directional arrow A32 of FIG. 18) in the second and fourth quadrants. Minimum diameter of cam member A28 is arbitrarily selected as 0.125 inches.

Figure 20:
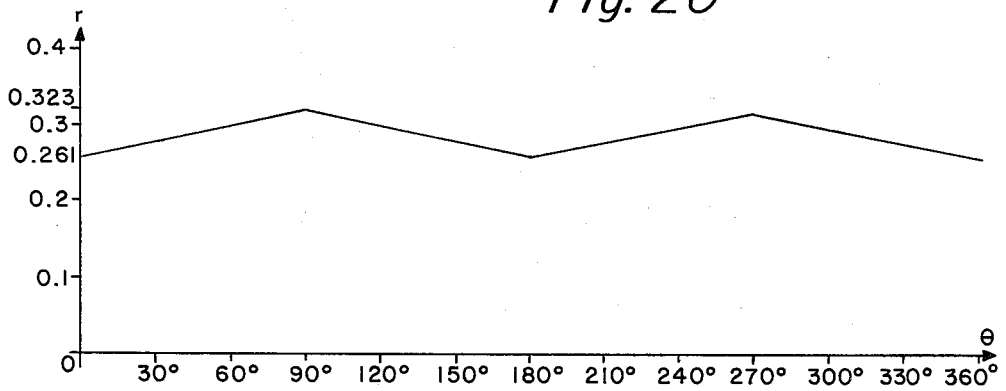
FIG. 20 is another graph showing other values used to derive the surface of the cam.

The parameter r may be defined as one-half of the minimum diameter of cam member A28 plus the radius of cylindrical portion A16 plus the amount of linear travel for any given angle of cam rotation $\theta$. This value r may also be plotted against angle $\theta$; this is illustrated in FIG. 20.

Figure 18:
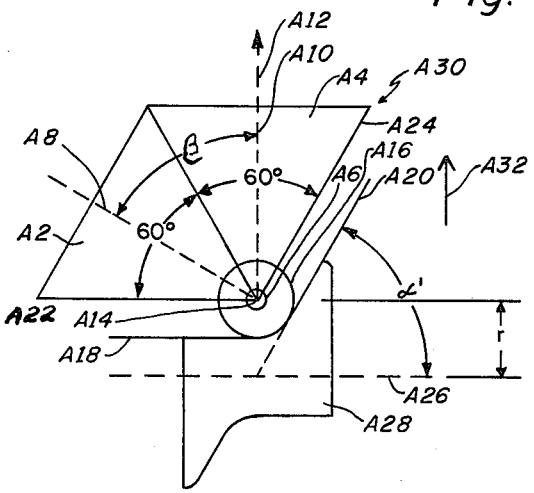
FIG. 18 is a diagrammatic plan view of a cam and a portion of a cam follower.

These plotted relationships may be solved to produce a function R of variables r, $\alpha$ and x, where r and $\alpha$ are defined as above and x is defined as the distance along the cam member A28 from axis A12, as is shown in FIG. 18. This relationship is, in this case:

$$R=r+x\tan\alpha-(0.136/\cos\alpha)$$

Cylindrical portion A16 makes it desirable to modify the surface of cam element A28 to provide a smooth mating with the said cylindrical portion; this portion of the cam surface may be defined as $$R=r-0.136\cos\{\sin^{-1}(x/0.136)\}$$

bearing in mind that the value 0.136 is equivalent to the radius of cylindrical portion A16. Thus the cam surface may be defined as $$R=r-0.136\cos\sin^{-1}\{(x/0.136)\}$$

for $0\leqq x\leqq 0.136\sin\alpha$ $$R=r+x\tan\alpha-(0.136/\cos\alpha)$$

for $0.136\sin\alpha<x\leqq x'$ where x' is the maximum value for x.

Note that corners may be rounded over or flattened as shown.

Figures 21, 22:
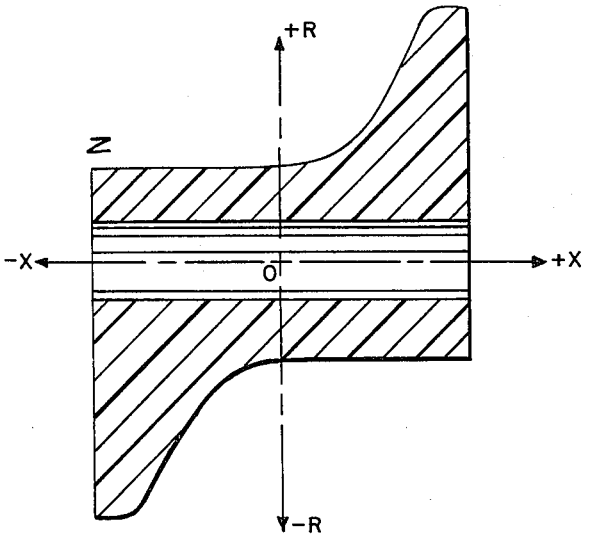
FIG. 21 is a cross-section taken on the cam along vertical line 21—21 of FIG. 17.
FIG. 22 is a table of dimensions which relate to the derivation of FIG. 21.

A diagrammatic cross-section of cam element A28 is shown in FIG. 21 with the said cross-section taken at $\theta=0°$. A table of values for R for various values of x appears in FIG. 22; values are taken around the periphery of the cross-section in a clockwise direction starting from point Z.

Figure 23:
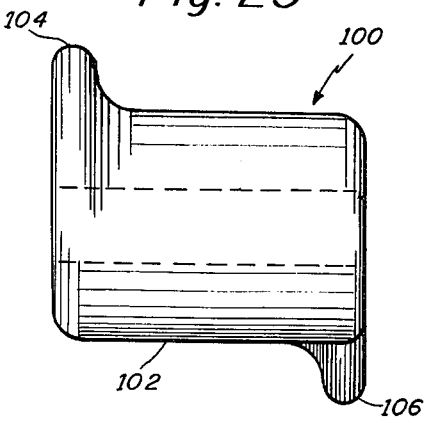
FIG. 23 is an elevational view of another form of cam.
Figure 24:
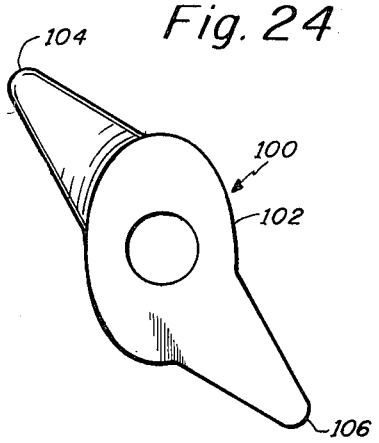
FIG. 24 is an end view of the cam of FIG. 23.

The preferred embodiment of the invention includes a cam member whose peripheral dimension increases gradually as it extends toward outer ends of the cam body. However, a simpler cam construction may be employed. One such simpler form is shown in FIGS. 23 and 24. Referring to these FIGS., numeral 100 generally denotes a cam member comprising an intermediate body portion 102 of substantially constant cross-section and having oppositely disposed projections 104 and 106 at either end thereof. The peripheral dimension of the intermediate portion 102 is substantially constant along its length; projections 104 and 106 correspond to lobular projections 15A and 15B of the earlier cam embodiment disclosed. A cam made in accordance with FIGS. 23 and 24 may provide a rotative movement which is less smooth in operation when compared with the preferred embodiment of the invention.

It may be desired to provide other embodiments of this invention in which certain of the parameters are changed. For example, it may be desired to provide a socket component for carrying three bulbs in which the third bulb may be of a reduced wattage so as to reduce battery drain during an emergency. Such a socket holder body is shown diagrammatically in FIG. 25, along with certain portions of its associated cam element.

Figure 25:
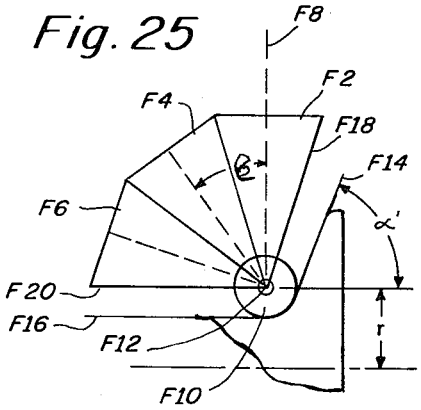
FIG. 25 is a diagrammatic plan view of another form of cam and cam follower arrangement.

Since there are three socket elements shown diagrammatically in FIG. 25 and denoted by references F2, F4 and F6 respectively, provision must be made to move any one of the three into position along the axis F8 of linear travel. This requires division of the available 180° of rotary motion into five equal segments, each of 36°. Angle $\beta$ i.e., the angle between the central axes of adjacent socket segments (FIG. 25), will also be 36°. A cylindrical part F10, bearing trunnion extensions as F12, is provided as before, as are cam follower surfaces F14 and F16 (parallel to schematically shown boundaries F18 and F20 respectively).

Figure 26:
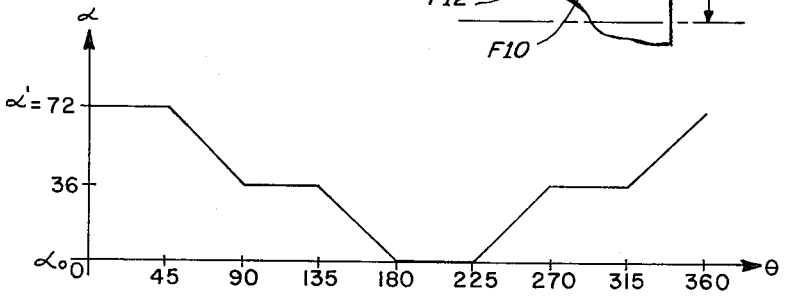
FIG. 26 is a chart showing values used to derive the cam surface of the cam shown in FIG. 25.

Desired performance may be plotted graphically in a manner similar to that already disclosed; FIG. 26 shows a plot of rotary motion angle $\alpha$ versus angle of cam rotation $\theta$. Angle $\alpha_o$ is equal to 0°, while angle $\alpha'$ (maximum rotation) will be 72° as shown.

Cam rotation provides the following sequence of operations:

1. Segment F2 moves outward to provide focusing.
2. Socket is moved back while simultaneously being rotated to position segment F4 along the focal axis.
3. Segment F4 moves outward to provide focusing.
4. Socket is moved back while simultaneously being rotated to position segment F6 along the focal axis.
5. Segment F6 moves outward to provide focusing.
6. Socket is moved back while simultaneously being rotated to position segment F2 along the focal axis.
7. Segment F4 moves outward to provide focusing.
8. Socket is moved back while simultaneously being rotated to position segment F2 along the focal axis.

Since eight regions of operation are required, each region will occupy 45° of cam rotation. $\theta$ is the angle of socket rotation and $\alpha$ is plotted versus $\theta$ in FIG. 26.

Figure 27:
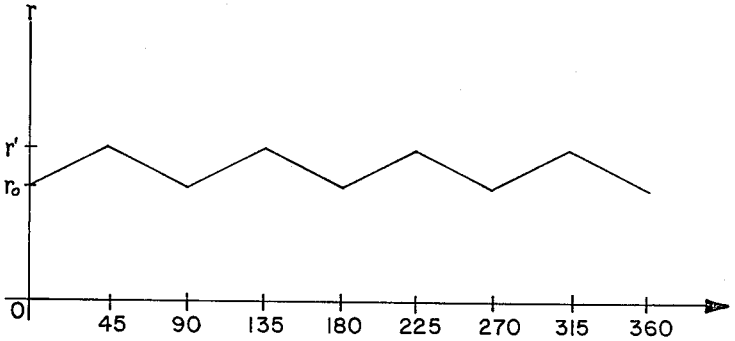
FIG. 27 is another chart showing further values which may be used to derive the surface of the cam shown in FIG. 25.

Dimension r is plotted versus $\theta$ in FIG. 27; note that r is defined in a manner similar to that previously described. For purposes of FIG. 27 maximum and minimum values of r are denoted $r'_0$ and $r_0$ respectively.

Equations may be mathematically and geometrically derived from the plots as before.

Note that many other configurations are possible; virtually any combination of rotary and linear motion in the manner specified may be obtained without departing from the principles of the invention. For example, it may be desired to provide the following sequence of operation for the socket of FIG. 25:

1. Segment F2 moves outward gradually to r' to provide focusing.
2. Socket moves back to $r_0$ abruptly; rotary motion then positions socket segment F4 along the focal axis.
3. Segment F4 moves outward gradually to r' to provide focusing.

4. Socket moves back to $r_0$ abruptly; rotary motion then positions segment F6 along the focal axis.
5. Segment F6 moves outward gradually to r′ to provide focusing.
6. Socket moves back to $r_0$ abruptly; rotary motion then positions segment F2 along the focal axis.

Figure 28:
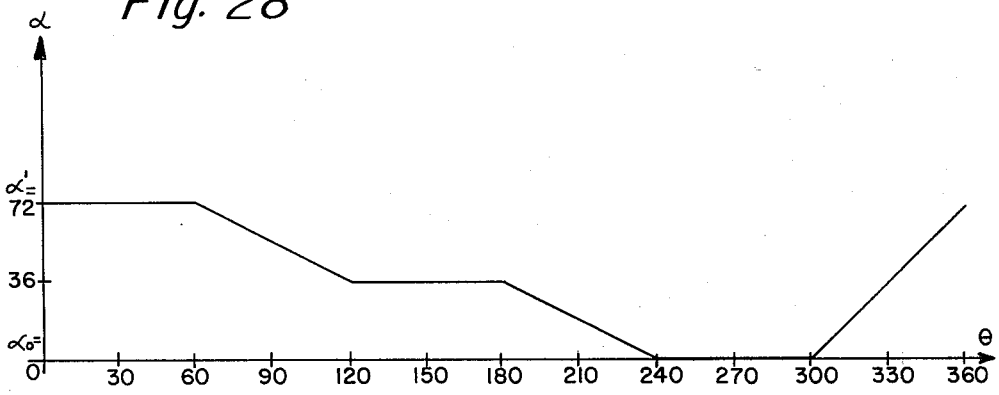
FIGS. 28 and 29 are charts illustrating values used to construct the surface of a modified form of cam.
Figure 29:
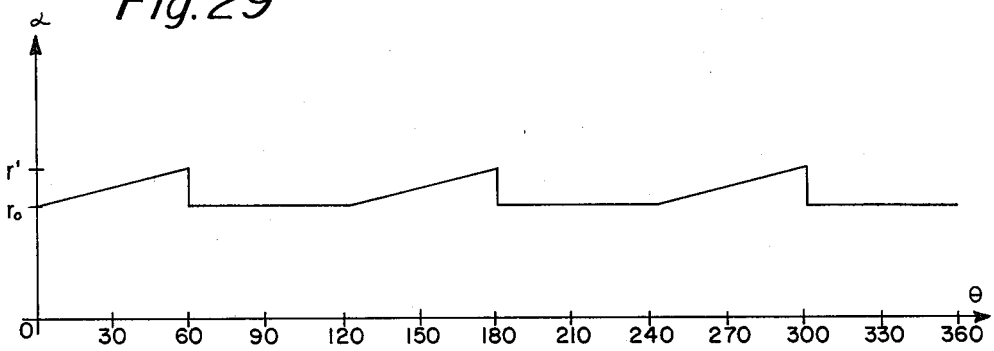

Here six regions of operation are required; plots corresponding to FIGS. 26 and 27 are shown as FIGS. 28 and 29 for this case. It will be noted from FIG. 29 that the rotary motion of $\theta$ is not reversible.

Figure 30:
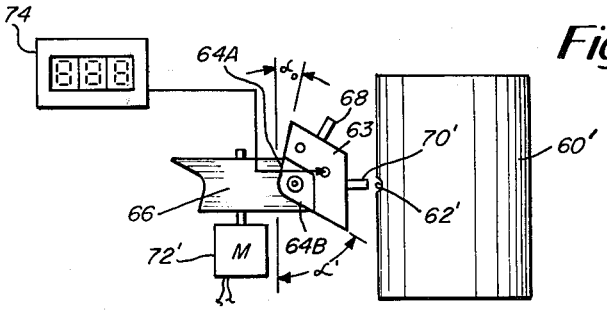
FIGS. 30 to 33 illustrate a modification of the invention in which a holder body is utilized to position sensing devices including light sensing and heat sensing.
Figure 31:
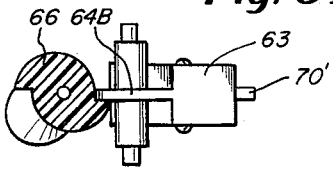

The method and apparatus for moving a holder body in accordance with this invention may be utilized in other forms of apparatus in addition to energy emitting devices such as a luminaire apparatus. FIG. 30 illustrates a modification of apparatus in which a holder body supports energy sensing means with the several parts being indicated diagrammatically. The sensing means is arranged to detect and, if desired, measure automatically and sequentially radiant energy such as visible light and temperatures within an enclosure body 60′ wherein the only means of access to the interior of the enclosure body is through a single wall aperture 62′.

Figure 32:
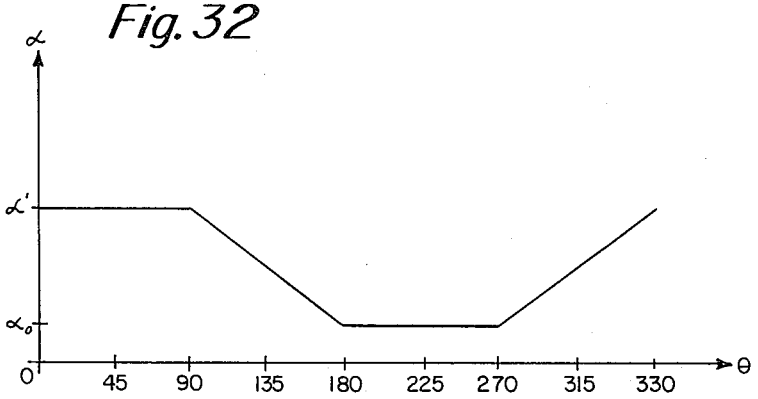
Figure 33:
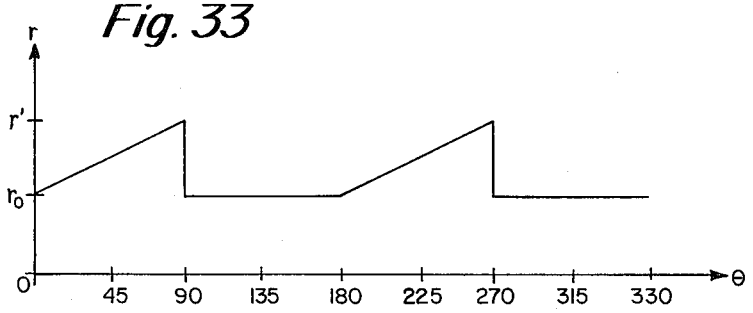

A cam and cam follower assembly includes a holder body 63, cam follower surfaces 64A and 64B formed on the holder body, and cam means 66. Supported in the holder body is a sensor 68 consisting of a photocell for measuring visible light and a sensor 70′ comprising, for example, a thermocouple for measuring heat. Cam 66 is constructed in the manner disclosed above with curved surfaces derived from value such as illustrated diagrammatically in FIGS. 32 and 33. The cam may be driven by a motor 72′. Electrical contact between the active sensor and a read-out device 74 is carried out in the same manner as earlier disclosed with contact springs (not shown) carrying out electrical contact with contact buttons which are suitably connected to a power source (also not shown). It is intended that the movement of a holder in accordance with the invention methods may also be employed with various other energy sensing devices such as bolometers and the like, and it may also be desired to utilize both an energy emitting device and an energy sensing device in a common holder body of the invention.

Figure 34:
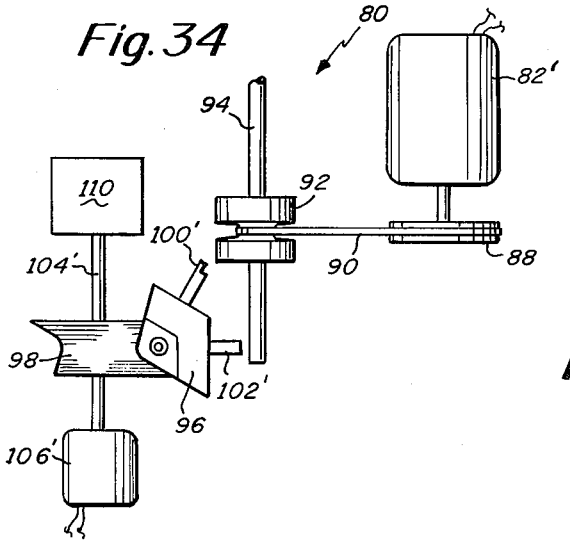
FIGS. 34 through 37 illustrate another modification of the invention in which a holder body is utilized to transfer energy in machine tooling operation.
Figure 35:
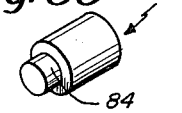
Figure 36:
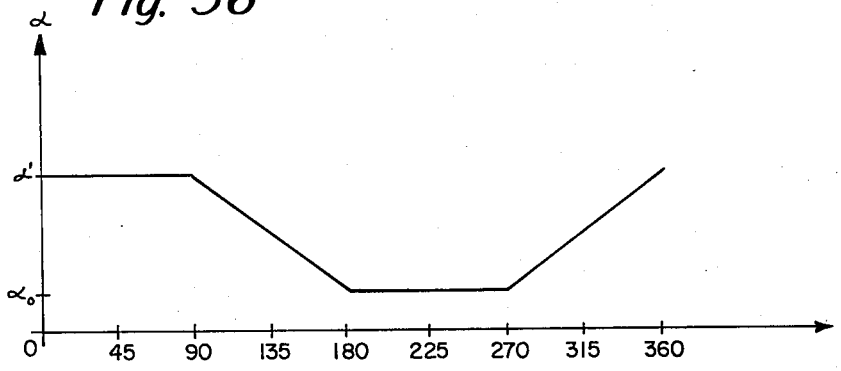

In addition to energy emitting and energy sensing devices, it may also be desired to combine with a cam actuated holder body energy transferring means such as has, for example, been illustrated in FIGS. 34–36 inclusive. Arrow 80 denotes a small machine tool which is utilized to shape a workpiece arrow 82 (FIG. 35). As shown in FIG. 35 it will be observed that the workpiece 82 is made of cylindrical form and a portion 84 at one end has been provided with a reduced diameter. The machine 80 comprises a motor 82′ having operatively connected thereto a drive wheel 88 which drives a belt 90 in turn engaged around a chuck member 92. Received in the chuck member 92 is a length of cylindrical rod stock 94. In combination with this apparatus is a holder body 96 formed with cam follower surfaces of the type earlier disclosed engageable with a cam 98. The holder body 96 has supported therein two cutting tools including a tool 102′ which produces the end 84 of workpiece 82, and a tool 100′ which cuts the piece of stock to a desired length. Cam 98 is fixed on a shaft 104′ driven by a motor 106′.

Figure 37:
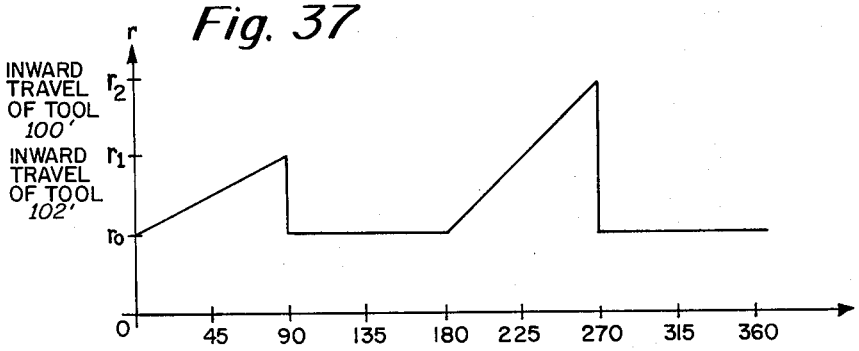
Figure 38:
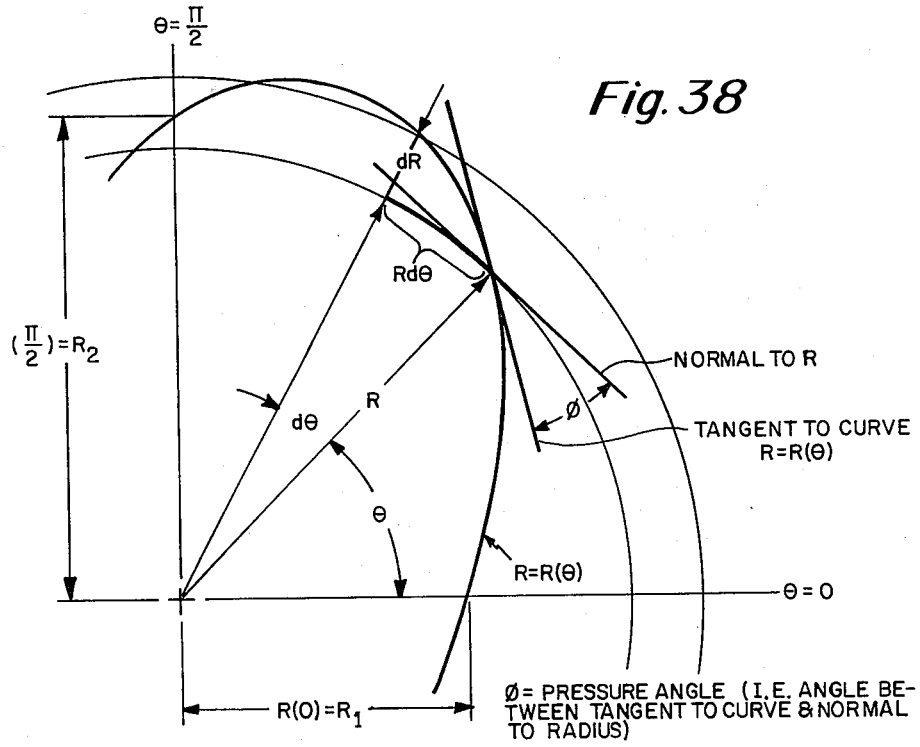
FIG. 38 is a diagram illustrating values used in deriving a cam surface which provides a constant pressure angle between a cam and a cam follower surface.

Curves for deriving the surfaces of cam 98 are shown in FIGS. 36 and 37. It will be noted that no electrical power need be applied to the holder and cam follower surfaces. However, for other devices, e.g. tools for drilling and countersinking, it may be desired to provide at least one small electrical motor, which may be located within the holder body and which may be connected to a suitable power source via contact springs and buttons as previously disclosed.

It will also be noted that the shaft 104′ may have supported thereon additional cam elements and associated devices generally indicated by the enclosure body 110 which may, for example, open and close chuck member 92 and advance the stock 94.

In certain embodiments, most particularly where tools are being driven as in the embodiment of the invention illustrated in FIGS. 34–36, it may be desired to have the linear travel of the holder body and its cam follower surfaces not vary in a linear relationship with the angle of cam rotation $\theta$ as shown, but to provide a cam surface which produces a constant pressure angle between the cam surface and the cam follower surface. The radius of the cam element, it will be noted, will still vary between $r_0$ and $r_1$ for angles between 0° and 90°. The precise radius R may be calculated by referring to FIG. 37.

In FIG. 37 the pressure angle is denoted as $\phi$ and is defined as the angle between the normal to the radius R and the tangent line to the surface for any given point thereon. It may be desireable to have the angle $\phi$ held constant as R varies between $R_1$ (where $\theta=0°$) and $R_2$ (where $\theta=90°$ or $(\pi/2)$ radians).

Thus:

$$\phi = \tan^{-1}\left\{\frac{dR}{Rd\sigma}\right\} = \text{constant, or}$$

$$\frac{dR}{Rd\sigma} = C_1$$

and:

$$\frac{dR}{R} = C_1 d\sigma$$

$$\ln R = C_1\sigma + C_2 \ (C_2 \text{ is a constant})$$
$$e^{\ln R} = e^{C_1\sigma} + C_2$$
$$R = (e^{C_1\sigma}) \cdot (e^{C_2})$$

now let $e^{C_2} = C_3$ $$R = C_3\, e^{C_1\sigma}$$

and apply boundary conditions:

$$R(0) = R_1$$

$$R\left(\frac{\pi}{2}\right) = R_2$$

$$\therefore \quad R_1 = C_3\, e^{C_1 0} = C_3$$

and $$R_2 = C_3\, e^{C_1 \frac{\pi}{2}} = R_1 e^{C_1 \frac{\pi}{2}}$$

or $$\frac{R_2}{R_1} = e^{C_1 \frac{\pi}{2}}$$

$$\ln \frac{R_2}{R_1} = C_1 \frac{\pi}{2}$$

-continued $$\frac{2}{\pi}\ln\frac{R_2}{R_1} = C_1$$

and $$R = R_1 e^{[(\frac{2}{\pi}\ln\frac{R_2}{R_1})\sigma]}$$

where $\theta$ is in radians. This relationship may be superimposed on the curve (FIG. 37) of r vs. $\theta$, where $R_1 = r_0$ and $R_2 = r_1$, replacing the linear relationship shown.

In the luminaire embodiment of FIGS. 26 and 27, the pressure angle of the numerical example varies between 17.65° and 11.98°. Applying the above relationships, the pressure angle may be held constant at 14.47°. The actual curve will differ only very slightly from that shown in FIG. 27, however.

We claim:

1. Luminaire apparatus of the class described comprising a housing having a reflector chamber which is closed at one side of the housing by a radiation transmitting member, an opposite side of the housing being extended to form a lamp socket enclosure part and a cable entry space, said lamp socket enclosure part having received therein dual rotary socket means and lamp elements therein, said socket means being resiliently mounted in the lamp socket enclosure for sliding movement along the central axis of the reflector chamber and being rotatable about an axis extending at right angles to the said central axis.

2. The invention of claim 1 in which the enclosure body supports a reflector member, said reflector member being recessed to provide a lamp socket aperture through which the dual rotary socket means may be rotated, said lamp socket means being structured to define spaced apart concaved reflector surfaces in each of which respective lamp elements are arranged, electrical means for independently energizing the lamp elements, cam means supported for rotative movement in the housing, said cam means being engageable with the socket means to produce sliding movement for focusing in one portion of the cam and said cam in another position of adjustment being engageable with the socket means to turn the socket means about an axis extending at right angles to the said central axis.

3. The invention of claim 2 in which the cam means is formed with an intermediate body portion for carrying out sliding movement of the socket and said cam being further formed at its opposite outer ends with projections for turning the socket about an axis at right angles to the central axis of the reflector chamber.

4. The invention of claim 3 in which the lamp socket is resiliently supported by retaining springs secured to inner spaced apart side portions of the enclosure body.

5. The invention of claim 2 in which the lamp socket is slideably mounted on trunnion portions formed at spaced apart sides thereof and the trunnion portions are guided in channeled parts of the enclosure body and said trunnion portions being arranged to bear against pin members opposite ends of which are received in spring elements secured within the enclosure body.

6. The invention of claim 1 in which the enclosure body supports a reflector member, said reflector member being recessed to provide a lamp socket aperture through which the dual rotary socket means may be rotated, said lamp socket being structured to define spaced apart reflector surfaces in each of which respective lamp elements are arranged, electrical means for independently energizing the lamp elements, cam means supported for rotative movement in the housing, said cam means being engageable with the socket to produce sliding movement for focusing in one portion of the cam and said cam in another position of adjustment being engageable with the socket to turn the socket about an axis extending at right angles to the said central axis of the reflector body and the enclosure body having supported thereon electrical contact means arranged in spaced apart relation to energize a lamp which is positioned along the central axis of the reflector body and further to maintain a condition wherein neither lamp is energized when neither bulb is positioned along said central axis.

7. Luminaire apparatus comprising a housing closed at one side by a radiation transmitting member, an opposite side of the housing being formed with an extension defining chamber means, a reflector body mounted within the housing and being recessed to provide a socket aperture, a multiple light source socket having reflector portions and bulbs received in respective reflector portions, each of said reflector portions and respective bulbs being rotatable into a position to complement and substantially close the said socket aperture, cable means located through the housing extension for electrically connecting the bulbs to a power source, said apparatus being further characterized by a cam and cam follower mechanism for moving the socket longitudinally along the central axis of the reflector body and rotating the socket along an axis of rotation which intersects at right angles to the central axis of the reflector body.

8. The invention of claim 7 in which the cam and cam follower mechanism includes a cam member rotatably mounted in the housing and being characterized by a lobular construction in which lobes are formed at opposite ends of the cam and an intermediate body portion of oval cross-section.

9. The invention of claim 8 in which the cam member is formed with an intermediate portion of oval cross-section and cam follower edges which converge to provide a rounded bearing end engageable with the intermediate body portion of oval cross-section to produce movement of the socket along a linear path of travel extending at right angles to the axis of rotation of the socket induced by the cam lobes.

10. The invention of claim 9 in which the chamber means of the housing extension is formed with spaced apart channels and the rounded bearing end presenting trunnion portions at upper and lower sides thereof and arranged for reciprocating movement in the said channels.

11. The invention of claim 10 in which the cam and socket mechanism is further characterized by driver pin means anchored in the housing and means for compressibly engaging the driver pins and forcing them against respective trunnions of the socket.

12. The invention of claim 10 in which the said socket is characterized by at least one electrical contact button and the said housing has secured thereto at least one electrical contact spring engageable with the contact buttons.

13. The invention of claim 12 in which the housing body is further characterized by retaining springs secured to the housing for engagement with the driver pins.

14. The invention of claim 13 in which the retaining springs are formed with recessed portions in which ends of respective driver pins are received.

15. The invention of claim 14 in which are provided electrical contact buttons including at least one button for selectively energizing at least one bulb member and at least one button for maintaining all bulbs in a de-energized condition.

* * * * *